US008746116B2

(12) United States Patent
Economaki

(10) Patent No.: US 8,746,116 B2
(45) Date of Patent: Jun. 10, 2014

(54) METHOD AND APPARATUS FOR MAKING WIDE CUTS

(76) Inventor: John J. Economaki, Lake Oswego, OR (US)

( * ) Notice: Subject to any disclaimer, the term of this patent is extended or adjusted under 35 U.S.C. 154(b) by 1269 days.

(21) Appl. No.: 12/554,038

(22) Filed: Sep. 4, 2009

(65) Prior Publication Data

US 2011/0056347 A1 Mar. 10, 2011

(51) Int. Cl.
*B26D 1/00* (2006.01)
*B26D 5/00* (2006.01)
*B43L 7/10* (2006.01)

(52) U.S. Cl.
USPC ..... 83/13; 83/821; 83/839; 33/452; 33/812; 33/613

(58) Field of Classification Search
USPC ..... 33/452, 812, 811, 810, 626, 783, 613, 33/645, 640, 641; 83/13
See application file for complete search history.

(56) References Cited

U.S. PATENT DOCUMENTS

| | | | | | |
|---|---|---|---|---|---|
| 445,646 | A * | 2/1891 | Welsh | 33/44 |
| 1,342,288 | A * | 6/1920 | Ichiba | 33/810 |
| 2,770,046 | A * | 11/1956 | Wichmann | 33/811 |
| 4,574,485 | A * | 3/1986 | Kreutz et al. | 33/783 |
| 5,465,498 | A * | 11/1995 | Lycan | 33/645 |
| 5,628,119 | A * | 5/1997 | Bingham et al. | 33/613 |
| 6,901,681 | B2 * | 6/2005 | Bueno | 33/647 |
| 7,069,659 | B1 * | 7/2006 | Rye | 33/194 |
| 7,216,441 | B2 * | 5/2007 | Batora | 33/836 |
| 2002/0170189 | A1 * | 11/2002 | Cheatham | 33/194 |

* cited by examiner

*Primary Examiner* — Omar Flores Sanchez
(74) *Attorney, Agent, or Firm* — McKee, Voorhees & Sease, P.L.C.

(57) ABSTRACT

A kerf making machine includes a table. A slide assembly comprises first, second, and third slides. The first slide has a first stop and a first abutment on the end thereof. The second slide has a second stop oppositely positioned to the first stop. The third slide has a third abutment on the end thereof and is positioned relative to the first abutment a distance that is the exact distance of the desired distance. The slide assembly is reversed from its one side to its other side wherein the first slide, the second slide, and the third slide are positioned on the table.

13 Claims, 9 Drawing Sheets

METHOD AND APPARATUS FOR MAKING WIDE CUTS

BACKGROUND OF THE INVENTION

This invention relates to a method and apparatus for making a cut. Specifically it relates to a method and an apparatus that may be used to make a precise cut from an actual work piece rather than by trial and effort. Cuts in wood or other materials are made with a cutting tool that removes less material than needed. Consequently a cut is comprised of multiple passes for the desired result.

Trial and effort methods have been used, but these require a number of trials and efforts before the cut is complete. The method is time consuming and prone to error as it depends on the woodcutter's skill. The present invention gauges the actual material thickness and allows the user to precisely cut a mating groove or dado without measuring the exact width of the gauged material. It does not require trial and effort methods but makes a cut the first time that is precise and repeatable. The present invention also makes a calibration of the kerf width that is precisely equal to the actual kerf width.

Woodworkers make notches, grooves, dados, lap joints, etc., with cutters (primarily saw blades, dado blades and router bits) that are smaller than the actual groove required for the intended fit. Therefore, multiple cuts are required to create the desired width of the notch, groove, dado, lap joints, etc. This is done through trial and effort and is mistake prone. This invention removes the trial and effort and the resultant mistakes by allowing the user to make the two most important cuts, those that define the shoulder spacing by simply gauging the width of the stock that is to be inserted into the mating groove/dado, etc.

Traditionally, the ability of a craftsman to create grooves, dados and other joints where two pieces of stock are joined together is accomplished by making multiple cuts with a cutter/saw that creates a kerf smaller than the mating stock. Therefore a series of cuts are required, each enlarging the groove/dado until the desired width matches the mating stock. This method is achieved with trial and effort and relies on the skill of the craftsperson for accurate results. This method is time consuming and error prone.

This invention eliminates trial and effort and waste. The tool gauges the stock width with calipers or an actual block wood. Then it acts as a flip stop (or reversible stop) on any machine that makes a kerf. The results are predictable, reliable and allow the craftsperson to save time and reduce waste from mistakes.

This invention relies on the principle that each cutting tool makes a predictable kerf width (saws, router bits, etc.) that can be measured empirically or with precision measuring devices such as dial/digital calipers or other gauging methods (gauge pins for example). Once this distance (kerf width) is known, it can be used as an offset in the present invention and locked in place. This one time calibration is accurate until the cutting tool is sharpened or replaced whereby this process would need to be repeated. Once the present invention is calibrated to the particular kerf of a cutter, it is used as follows:

The craftsperson gauges the thickness of the stock that is going to mate in a groove or dado and locks the tool to this setting - - - there is no measuring. The tool creates two stops that embrace the work piece. These are transferred to a first abutment face that is on the end of the first slide and a third abutment face on the end of the third slide so that the first and third abutment faces extend one beyond another the exact distance of the stock that is going to mate in a groove or dado.

The tool is first put on one side with all the slides engaging the table. The first kerf is cut in the work piece. Then the tool is flipped or reversed and a second kerf is cut in the work piece. The exact distance between outsides of the first and second kerfs is equal to the distance of the stock that is going to mate in the groove or dado. This will enable the user to create extremely accurate grooves or dados without skill or trial and effort. The distance between the first and second kerfs is routed out and the cut is complete.

Therefore a primary object of the present invention is the making of a method and apparatus that makes a precise cut the first time.

A further object of the present invention is a method and apparatus that when placed on one side produces a first kerf and when placed on the other side produces a second kerf wherein the distance between the first kerf and the second kerf is precisely the same as a desired cut.

A further object of the present invention is the making of a method and apparatus that includes a slide assembly comprising a first slide having a first abutment, a second slide, and a third slide having a third abutment. The slide assembly having the third abutment face protrudes beyond the first abutment exactly the same as the desired cut.

A further object of the present invention is the making of a method and apparatus that includes a first stop on the first slide and a second stop on the second slide oppositely positioned with respect to the first stop, and a block of wood between the first stop and the second stop. A third abutment surface the end of the third slide extends beyond a first abutment surface on the end of the first slide exactly equal to the thickness of the block of wood.

A further object of the present invention is the making of a method and apparatus wherein a slide assembly is in an initial position and then is reversed or flipped to a reversed position.

A further object of the present invention is the making of a method and apparatus wherein a first slide extends beyond the third slide a distance that is exactly equal to a kerf's width.

A further object of the present invention is the making of a method and apparatus wherein a board is ripped and cross-cut to calibrate a rectangular piece that is a kerf width short and a window piece having a window and a shortened window edge. The rectangular piece is put into the window. The first abutment is placed on the rectangular piece and the third abutment is placed on the shortened window edge whereby the distance between the first and third abutment pieces is exactly equal to the kerf width.

A further object of the present invention is the making of a method and apparatus wherein the three slides are efficient, attractive in appearance, and made economically.

SUMMARY OF THE INVENTION

The forgoing objects can be achieved by an apparatus that includes a machine having a table and a kerf having a kerf width. A slide assembly comprises a first slide, a second slide, and a third slide mounted for sliding movement with respect to one another. The slide assembly has a first stop and a first abutment on the first slide, the first abutment being connected to the first stop for movement therewith. A second stop is on the second slide oppositely positioned to the first stop. A third abutment is on the third side. A work piece is embraced a work piece distance between the first and second stops. The first abutment and the third abutment are a predetermined distance from one another, the predetermined distance being exactly equal to the kerf width plus the work piece distance between the first and second stops.

According to another feature of the present invention a first screw device connects the first and second sides together, the first screw device being movable from a first fixed position securing the first and second slides in fixed relation to one another and a first open position permitting the first and second slides to slide with respect to one another. A second screw device connects the second and third slides together and is movable between a second fixed position securing the second and third slides in fixed relation to one another and a second open position permitting the second and third slides to slide with respect to one another.

According to another feature of the present invention the first screw device is in the open position to permit the first and second stops to slide to embrace the work piece, and thereafter the first screw device moves from the first open position to the first fixed position.

According to another feature of the present invention there is a cross-cut device being movable across table toward the kerf and a board is clamped to the cross-cut device.

According to another feature of the present invention the slide assembly has one side and another side oppositely positioned relative to the one side. The slide assembly being on the one side to make a first kerf in the work piece and being on the other side to make a second kerf in the work piece. The slide assembly having the first slide, the second slide, and the third slide engaging the table on both of the one side and the other side.

According to another feature of the present invention a fence is for ripping. A fence guide is for guiding the fence and a board is clamped onto the fence guide.

The foregoing invention may be achieved by a method comprising taking a table and a slide assembly comprising a first slide, a second slide, and a third slide mounted for sliding movement with respect to one another. A first stop and a first abutment are positioned one the first slide. A second stop is positioned on the second slide oppositely positioned with respect to the first stop. A third abutment is positioned on the third slide and is protruding beyond a first abutment on the first slide a predetermined difference. The slide assembly is placed on one side of the table wherein the first slide, the second slide, and the third slide engage the table. The slide assembly is reversed or flipped so that the first slide, the second slide, and the third slide engage the table.

According to another feature of the present invention, a first screw device connected to the first and second slides is movable between a fixed position securing the first and second slides in fixed relation to one another and a first open position permitting the first and second slides to slide with respect to one another. A second screw device connected to the second and third slides is movable from a second fixed position securing the second and third slides in fixed relation to one another and a second open position permitting the second and third slides to slide with respect to one another.

The foregoing invention may be achieved by a method comprising taking a slide assembly having a first slide, a second slide, and a third slide mounted for sliding movement with respect to one another. The slide assembly includes a first stop and a first abutment on the first slide, a second stop of the second slide oppositely positioned with respect to the first stop, and a third abutment on the third slide. The first abutment of the first slide protrudes beyond the third abutment of the third slide a predetermined distance.

According to another feature of the present invention involves taking a single board having opposite original edges. The single board is ripped and cross-cut to make a rectangular board and a window board having a window and a shortened original edge corresponding to the formation of a window from the opposite original edges of the single board. The rectangular board is placed into the window. The first abutment is positioned against the rectangular board, and the second abutment is positioned against the shortened original edge whereby the predetermined distance is equal to the width of a kerf.

DETAILED DESCRIPTION OF THE PREFERRED EMBODIMENT

Figure 1:
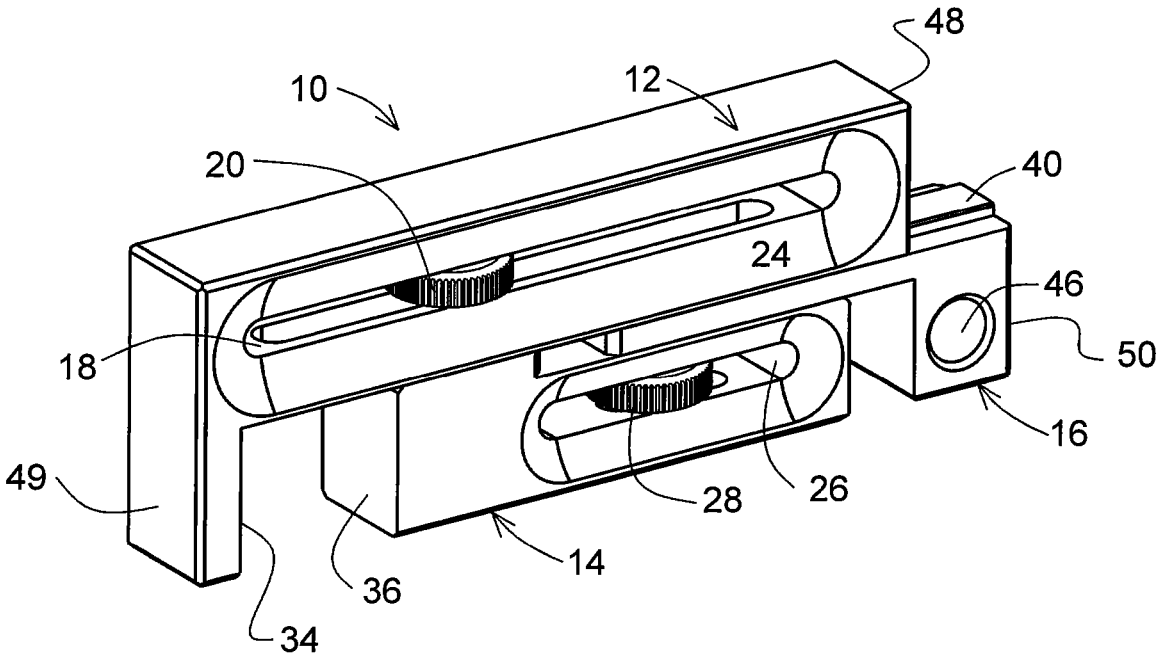
FIG. 1 is an isometric view of the device of the present invention.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstance may suggest or render expedient without departing from the spirit or scope of the invention as further defined in the following claims.

Figure 2:
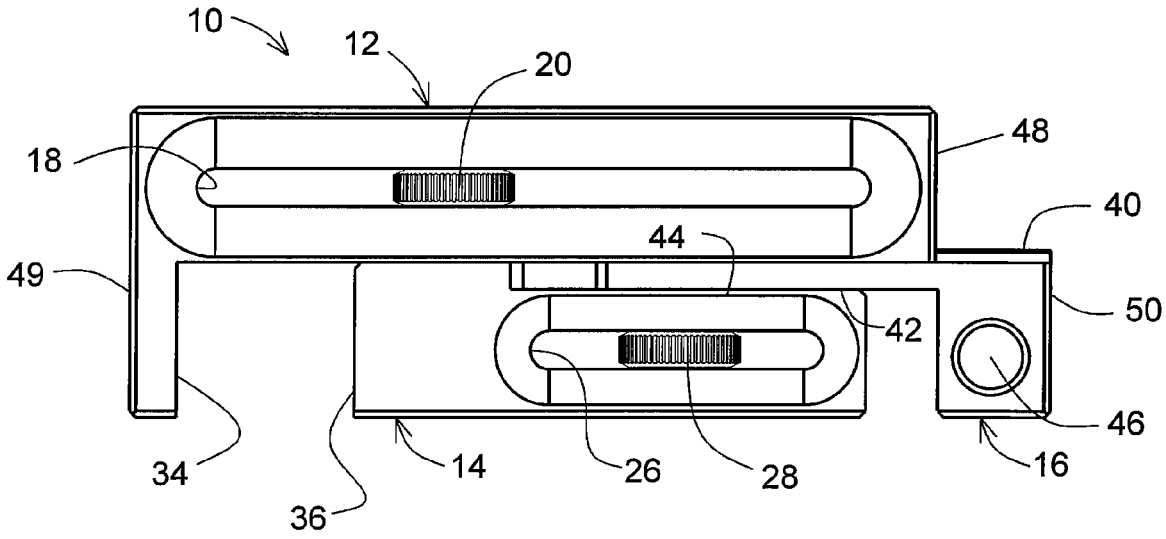
FIG. 2 is a front elevation view of the device shown in FIG. 1.
Figure 3:
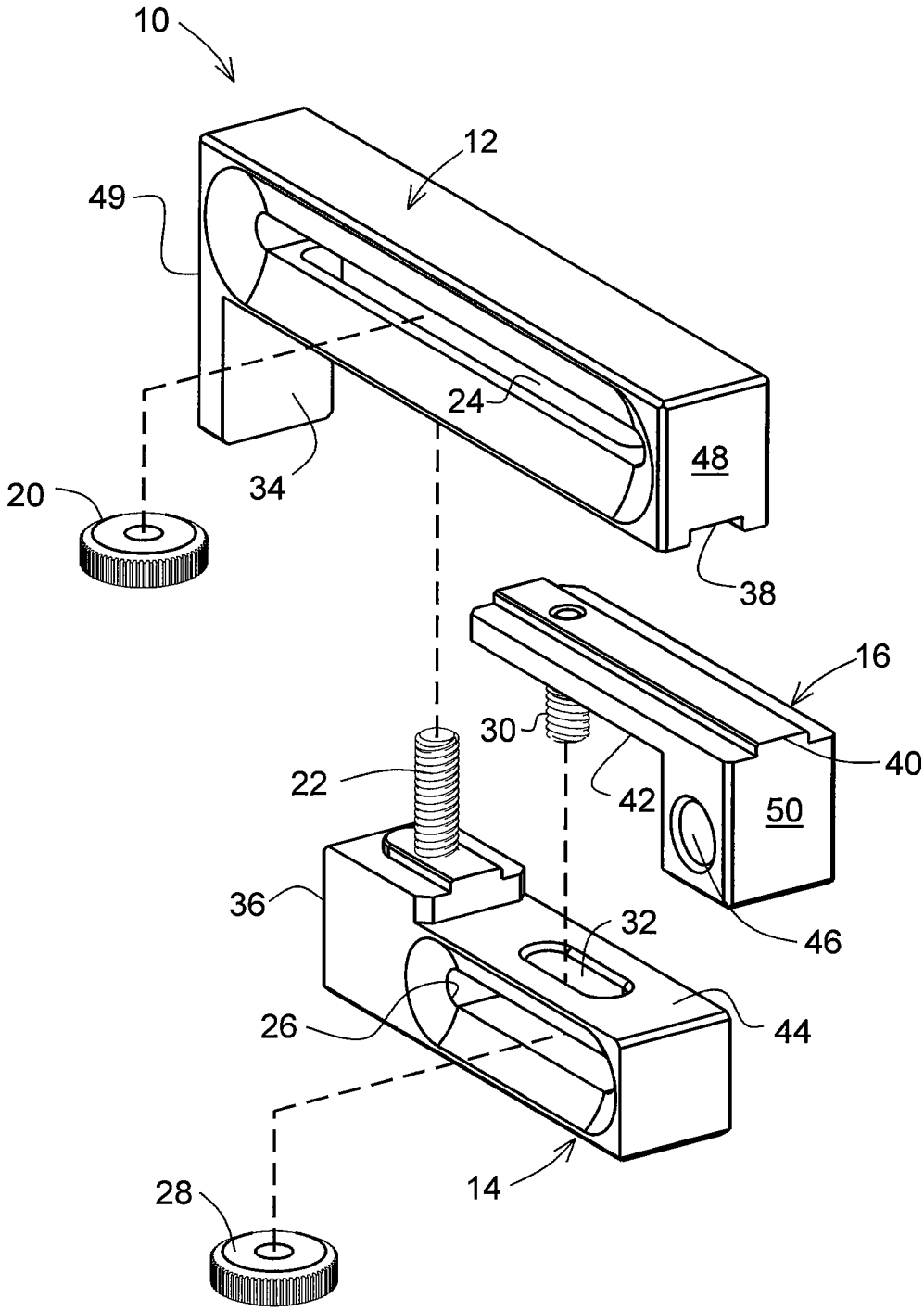
FIG. 3 is an exploded isometric view of the device shown in FIG. 1.

Referring to FIGS. 1-3, a cut device 10 is shown having a first slide 12, a second slide 14, and a third slide 16 mounted for sliding movement with respect to one another.

A first slot 18 is in first slide 12, and houses a first screw nut 20 screwed to a screw 22 extending up from second slide 14 through a first opening 24. A second slot 26 in second slide 14 houses a second screw nut 28 extending downwardly from third screw 16 through second opening 32. First and second slides are held together by first screw nut 20 and first screw 22. Second slide 14 and third slide 16 are held together by second screw nut 28 and second screw 30. Thus the first slide 12, the second slid 14, and the third slide 16 are held together, but may be mounted for sliding movement with respect to one another.

Figure 7:
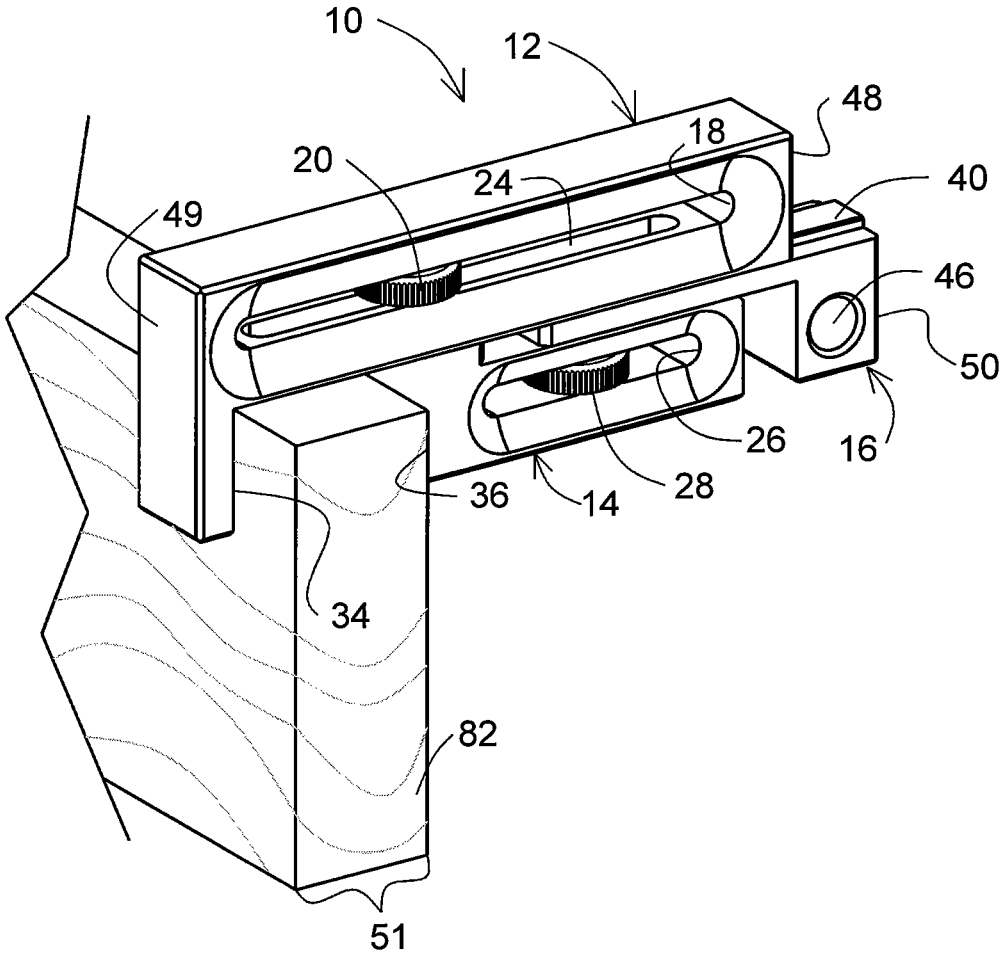
FIG. 7 is an isometric view of the device shown in FIG. 1 showing the use of a block of wood between the two stops.

Extending downwardly from first slide 12 is a first stop 34 with an outside face 49 and extending downwardly from second slide 14 is a second stop 36. These two stops 34, 36 are oppositely positioned with respect to one another and are adapted to embrace a work piece 82 therebetween (FIG. 7). This work piece 82 provides the exact measurement of the cut because it is the exact work piece 82. The abutment surfaces 48, 50 are initially aligned with one another. Because of the engagement of stops 34, 36, embracing the work piece 82 the abutment surface 50 extends beyond abutment surface 48 a distance that is exactly equal to the distance of thickness 51 of work piece 82.

The particular method for sliding slides 12, 14, and 16 with respect to one another may take many forms. One of the forms is shown in the drawings. A first slide groove 38 is shown on the surface of first slide 12. It is mounted for sliding movement along a slide slot 40 on the third slide 16. The sliding surface 42 is downwardly presented on the third slide 16, and the sliding surface 44 is upwardly presented on the second slide 14. A mounting hole 46 is provided in third slide 16, and is adapted to be mounted on a nail or other device (not shown).

An original board is ripped and cross-cut to create a window 124 and a short edge 126 of a windowed cut board 120. Similarly a rectangular board 116 is formed. The rectangular board 116 has a thickness that is short the width of a kerf produced by the saw or other device. Therefore, by lining up the first abutment surface 48 with a rectangular surface 128 on the rectangle and the third abutment surface 50 on the short edge 126, it is possible to achieve the distance of the kerf width 118. The second screw nut 28 is fastened from its open position wherein its free to slide to its fixed position wherein it fixes the second slide 14 to the third slide 16. The method may be varied. For example calipers may be used or other means can be used.

Figure 9:
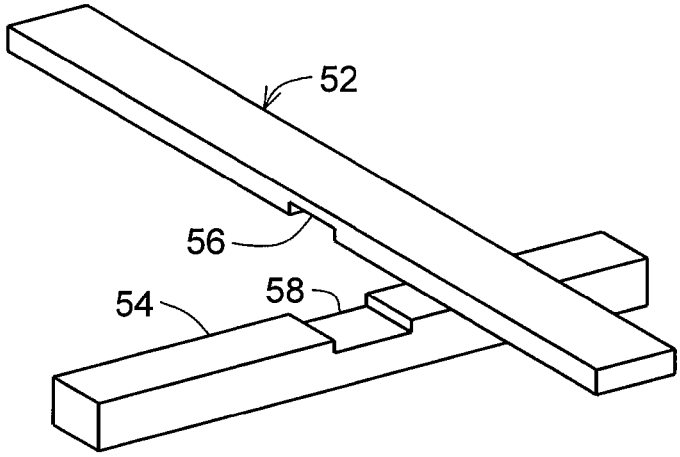
FIG. 9 is an isometric view of a lap joint that is cross-cut.
Figure 10:
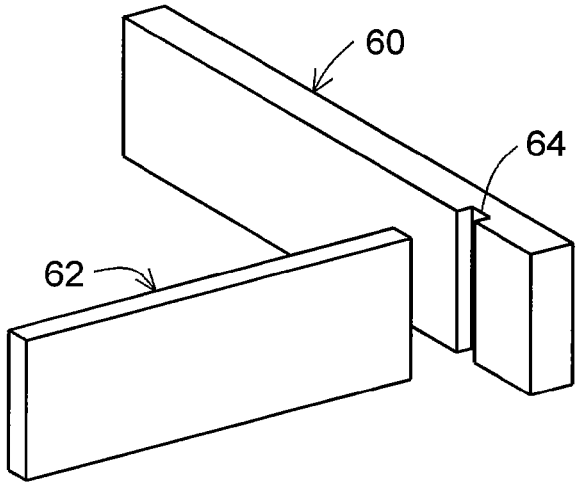
FIG. 10 is an isometric view of a dado joint that is cross-cut.
Figure 11:
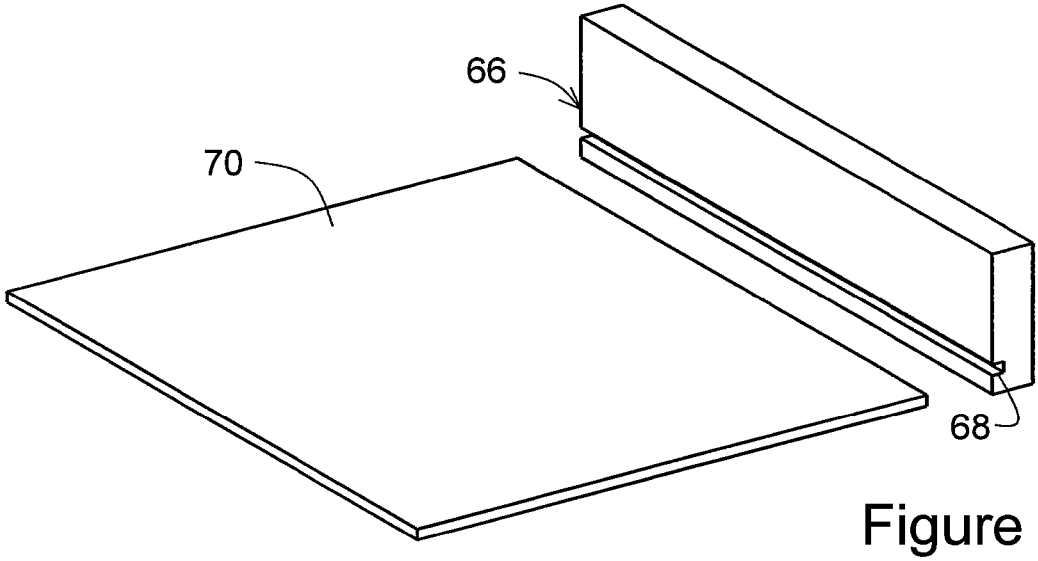
FIG. 11 is an isometric view of a ripped joint.

Various types of joints that can be made with cut device 10. Cross-boards 52, 54 (FIG. 9) have overlap joints 56, 58 respectively. A dado cut 64 (FIG. 10) is in boards 60, 62. These are cross-cut boards. A ripping joint 68 (FIG. 11) is ripped in a board 66 in which is inserted a board 70. This also is referred to as a dado joint 68.

In order to make the cross-cut lapping joints (FIG. 9) and the dado 64 (FIG. 10) a first work piece 82 (FIG. 7) is embraced by the first stop 34 and the second stop 36. On the end of the first slide 12 is a first abutment surface 48 and on the third slide 16 is a third abutment surface 50. The third abutment surface 50 of the third slide 16 protrudes beyond the first abutment surface 48 of the first slide 12 the exact distance of the desired cut. A work piece 82 is embraced by the stop 34 on first slide 12 and the stop 36 on second slide 16. Consequently the abutment surface 50 on third slide 16 is extended beyond abutment surface 48 on first slide 12 an exact distance that is equal to the thickness 51 of the wood block 82. This is because second screw nut 28 is fastened from its open position to its fixed position holding the second and third slides 14, 16 together.

The method of using the cut device 10 for cross-cutting (FIGS. 5 and 6) and ripping (FIG. 8) are shown. The cross-cutting method includes a cross-cut device 72 having a kerf slot 74 therein. The cross-cut device 10 is guided towards the saw blade 80 by a groove 76 in conventional fashion (not shown). The particular table top 78 may house a kerf maker that includes a saw blade, a band saw, a router, a dado blade, a jointer, or any device that includes a kerf maker.

A work piece 96 is shown having a first kerf 84 and a second kerf 86 therein. The first kerf 84 is made before the second kerf 86, but the two kerfs 84, 86 can reversed without detracting from the invention. A board 94 is clamped by clamp 90 to cross-cut device 72, and includes a stop 88 that has a thickness 92 that is less than the first abutment surface 48 of the first slide 12. The reason for the thickness 92 is that the cut device 10 must have two lengths, one comprising the ends of first slide 12 and one comprising the protrusion of the abutment surface third slide 16 plus the ends of first slide 12. The space between stop 88 and the work piece 96 is measured so that the cut device 10 fits within the space to create a first kerf 84. Then the cut device 10 is reversed so that the work piece 96 is repositioned, and a second kerf 86 is made. If necessary, the space between the first kerf 84 and the second kerf 86 is routed out. The cut device 10 makes the first kerf 84 and the second kerf 86 the exact measurements of the work piece 82.

Figure 8A:
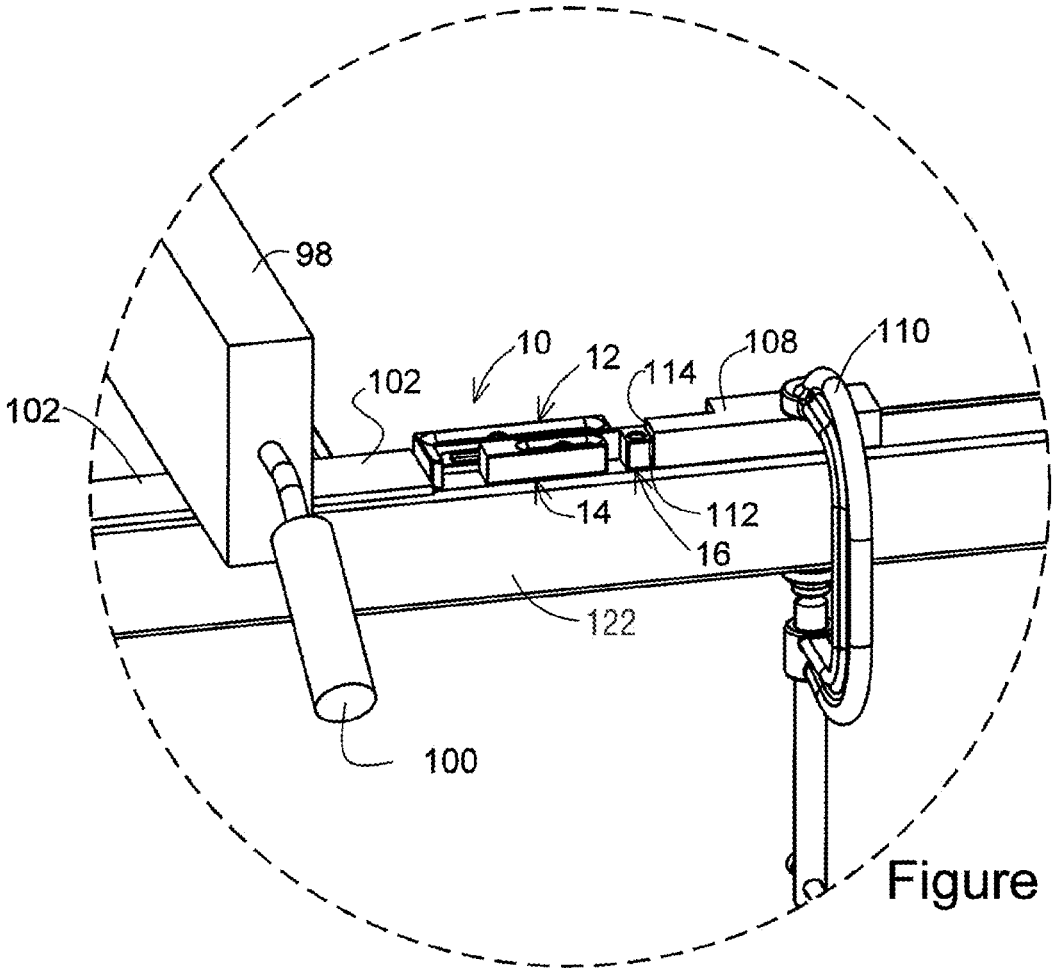
FIG. 8A is a detailed view taken along 8A of FIG. 8.
Figure 8:
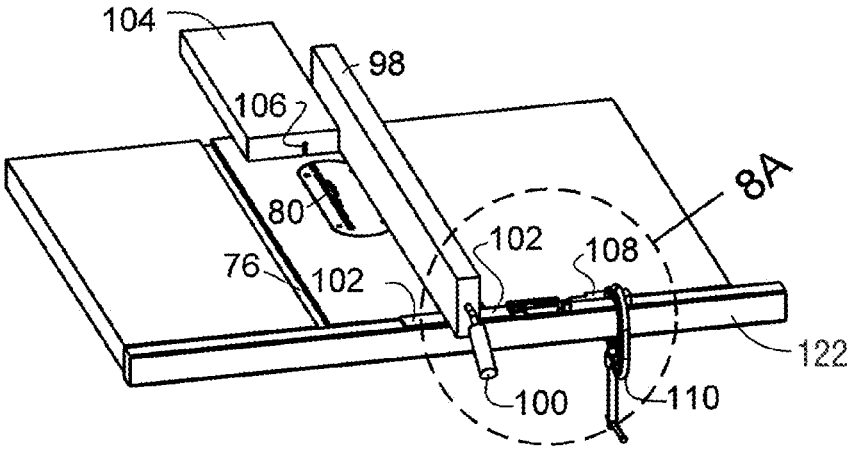
FIG. 8 is an isometric view of the device shown in FIG. 1 in a ripping mode.

The method of ripping is shown in FIG. 8 which shows a fence 98 having a straight edge surface and having a lever 100 for adjusting the fence 98. The fence 98 includes fence extensions 102 extending outwardly there from. A work piece 104 extends near the fence 98 and engages straight edge of the fence 98. A guide 122 is provided and is perpendicular to the fence 98. Guide 122 includes a groove therein. A block of wood 108 is clamped by means of a clamp 110 to guide 122. The block of wood 108 includes a stop 114 having a thickness 112 to a block of wood 108 which permits the cutting device 10 to be reversed to achieve different lengths. The cutting device 10 is then reversed so that first slide 12, second slide 14, and third slide 16 all engage the table 78.

Figure 4:
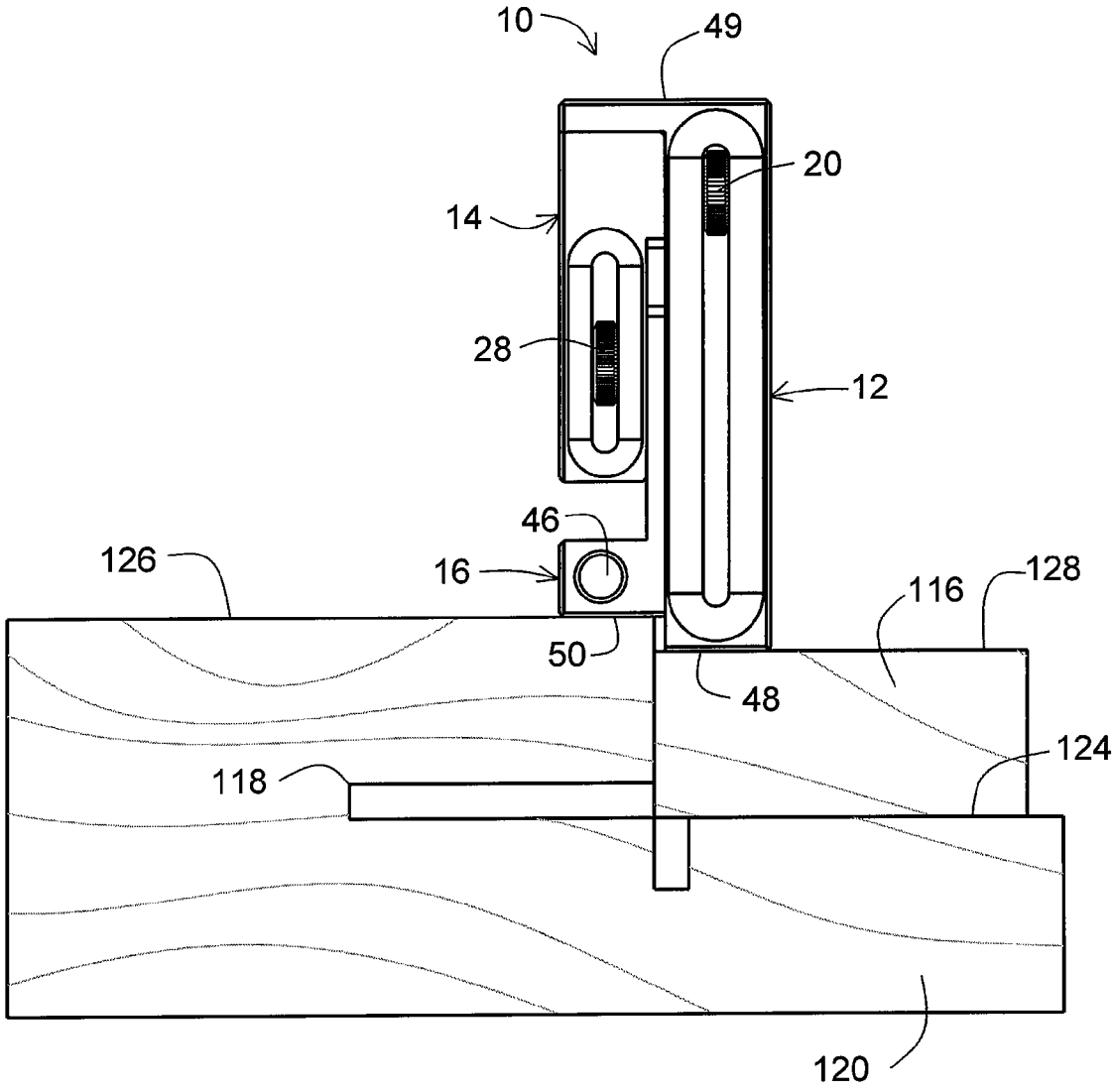
FIG. 4 is a front elevation view of the device shown in FIG. 1 showing the use of the device to determine kerf width.
Figure 5A:
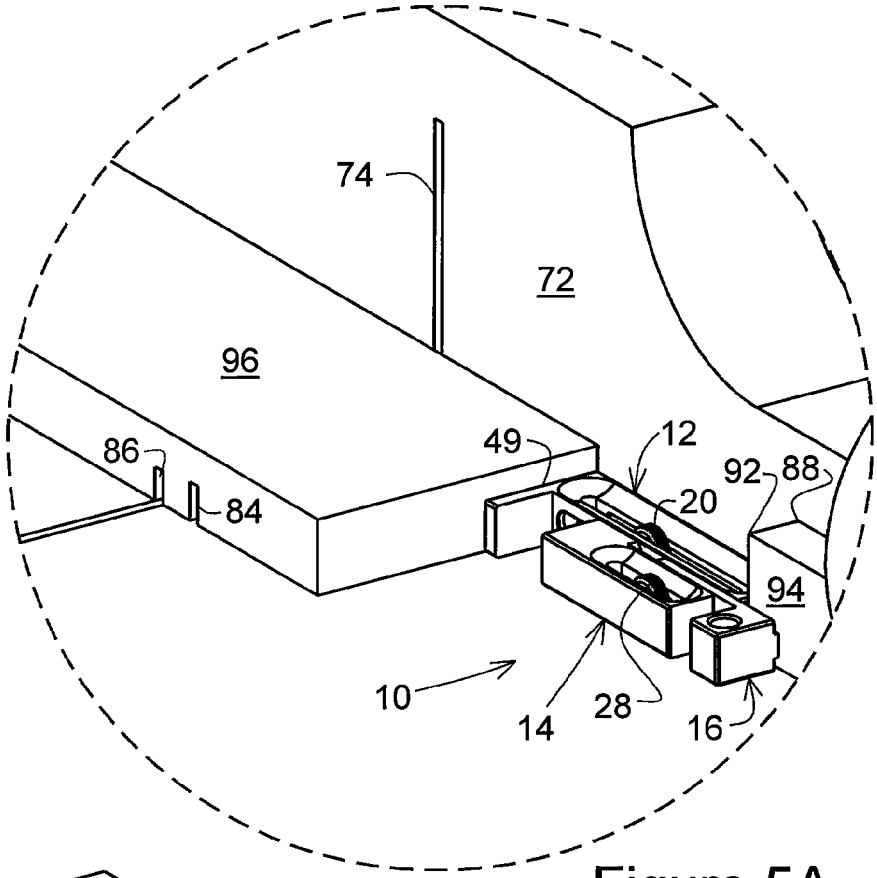
FIG. 5A is a detailed view taken along the line of 5A of FIG. 5.
Figure 5:
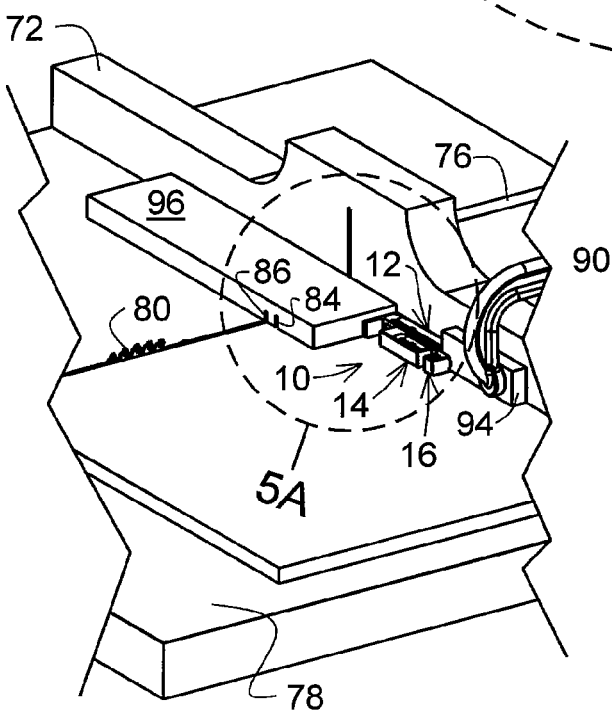
FIG. 5 is an isometric view of a table saw showing the device shown in FIG. 1 in one position in the cross-cut mode.
Figure 6A:
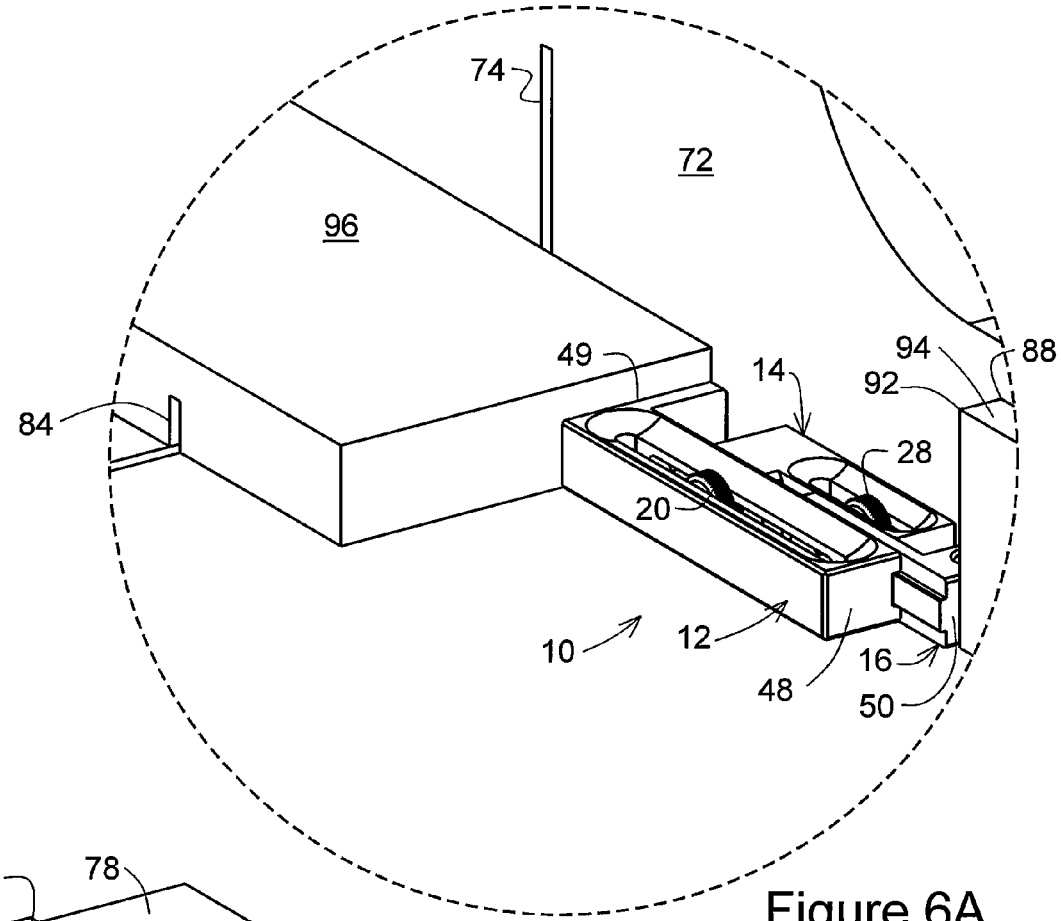
FIG. 6A is a detailed view taken along line 6A of FIG. 6.
Figure 6:
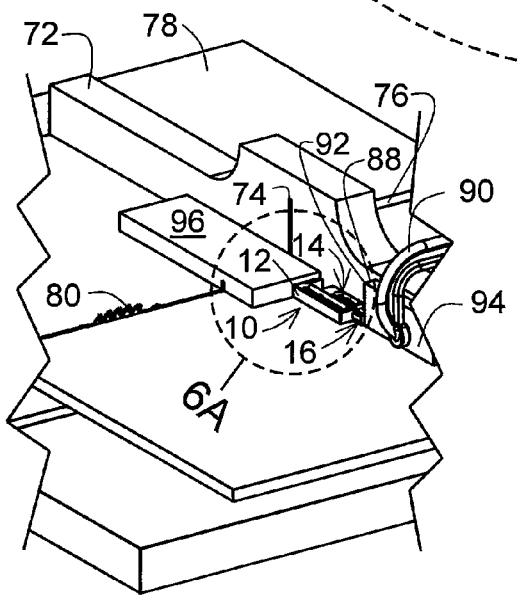
FIG. 6 is an isometric view of a table saw showing the device shown in FIG. 1 reversed from the one position in the cross-cut mode.

The cut device 10 for ripping is used the same way as in FIGS. 4 and 5 except the cut device 10 engages a fence 98 for ripping rather than cross cutting device 72. The cut device 10 is positioned between the stop 114 of the block of wood 108 and the extensions 102 of the fence 98. The cut device 10 is reversed so that it has a shortened or lengthened distance and the fence 98 is reset. This results in a second groove (not shown) which is exactly the same as the distance from the first groove 106 of the work piece 82 (FIG. 6).

Since the user is gauging the stock with finger pressure, it is possible to determine empirically the type of fit is in the space between the stop 88 and the work piece 96 (on the stop 114 and the fence extension 102). If the user squeezes the tool tightly on the stock while gauging, before a single shoulder cut is made, the tool will not fall off when the user turns the stock and the tool upside down. This is a tight fit and will yield a similar tight fit when the two pieces of wood are assembled—all without guesswork, measuring, and fear of error.

DEFINITION SECTION

Table: This may include any of a variety of tables including router, jointer, drill press, band saw, or other tables that include a kerf machine that has a kerf.

Slide assembly: This includes a slide assembly that encloses at least two slides, and preferably three. But it can include more than three.

First stop: This includes a stop on the first slide that is positioned opposite to the second stop.

Second stop: This includes a stop on the second slide that is positioned opposite to the first stop.

First abutment: This includes a face on the first slide that is positioned on the end of the first slide.

Third abutment: This includes a third abutment on the third slide that is positioned on the end of the third slide.

Screw device: This includes a device that connects two or three slides together for sliding movement with respect to the two or three slides.

Block: This includes a block of wood or other material that is sawable.

Fixed position: A position wherein the slides (whether the first, second, or third slides) are fixed with respect to one another.

Open position: A position wherein the slides (whether the first, second, or third slides) are free to slide with respect to one another.

Kerf Maker: Any device that makes a kerf whether a router, jointer, drill press, band saw, saw, or other machines for making a kerf.

Kerf: A groove or slit made by a kerf maker in a work piece.

Kerf width: The width of a kerf.

Protruding: The extending of an abutment head of a slide beyond the abutment head of another slide.

One side: The side wherein all of the slides engage the table.

Other side: The side wherein all of the slides engage the table.

Embracing: Placing of the slides in a position wherein the first stop and the second stop frictionally touch the block of wood there between.

Single Board: The board having squared off ends from which a rectangular board and window board are formed.

Rectangular Board: A rectangle cut from a window of a single board that has two diameters, each of which is one kerf width short of the single board it was cut from.

Window Board: The board made from a single board having a window therein and a short edge extending from the window downwardly.

What is claimed:

1. The method for making a cut comprising:

taking a slide assembly comprising a first slide, a second slide, and a third slide mounted for sliding movement with respect to one another;

positioning a first stop and a first abutment on the first slide, a second stop on the second slide oppositely positioned with respect to the first stop, and a third abutment on the third slide;

extending the first abutment of the first slide and the third abutment of the third slide beyond one another a predetermined distance;

taking a single board;

ripping and cross-cutting the single board to make a rectangular board and a window board having a window and a shortened window edge therein;

placing the rectangular board within the window; and engaging the first abutment of the first slide into the window against the rectangular board and the third abutment of the third slide against the shortened window edge whereby the predetermined distance is exactly equal to a kerf width of a kerf.

2. An apparatus for making a cut comprising:

a machine having a table and kerf maker with a kerf width;

a slide assembly comprising a first slide, a second slide, and a third slide mounted for sliding movement with respect to one another, the slide assembly having a one side and an other side wherein the first slide, the second slide and the third slide engage the table;

a first stop and a first abutment on the first slide, the first abutment being connected to the first stop for movement therewith;

a second stop on the second slide oppositely positioned to the first stop;

a third abutment on the third slide;

a work piece embraced between the first and second stops, the first and second stops being spaced apart from each other by a work piece distance corresponding with a thickness of the work piece;

the first abutment and the third abutment being a predetermined distance from one another, the predetermined distance being equal to the work piece distance less the kerf width.

3. The apparatus according to claim 2 wherein a first screw device connecting the first and second slides together, the first screw device being movable between a first fixed position securing the first and second slides in fixed relation to one another and a first open position permitting the first and second slides to slide with respect to one other; a second screw device connecting the second and third slides together, the second screw device being movable between a second fixed position securing the second and third slides in fixed relation to one another and a second open position permitting the second and third slides to slide with respect to one another.

4. The apparatus according to claim 3 wherein the first screw device being in the first open position to permit the first and second stops to slide to embrace the work piece, and thereafter the first screw device moving from the first open position to the first fixed position.

5. The apparatus according to claim 2 comprising a cross-cut device movable across the table toward the kerf maker; and a board being clamped onto the cross-cut device.

6. The apparatus according to claim 2 wherein the slide assembly has a one side and an other side oppositely positioned relative to one another; the slide assembly being on the one side to make a first kerf in the work piece and being on the other side to make a second kerf in the work piece; the slide assembly having the first, second, and third slides engaging the table both when on the one side and the other side.

7. The apparatus according to claim 2 wherein a fence for ripping, a fence guide for guiding the fence and a board being clamped onto the fence guide.

8. A method for making a cut of a desired cut distance using a cutting device that has a kerf width comprising:

providing a table and a slide assembly comprising a first slide, a second slide, and a third slide mounted for sliding movement with respect to one another;

positioning a first stop on the first slide and a second stop on the second slide oppositely positioned with respect to the first stop;

extending a third abutment of the third slide beyond a first abutment of the first slide a predetermined distance, the predetermined distance being equal to the desired cut distance less the kerf width;

placing the slide assembly of the table on a first side of the slide assembly wherein the first slide, the second slide, and the third slide engage the table;

reversing the slide assembly to a second side of the slide assembly opposite from the first side so that the first slide, the second slide, and the third slide engage the table.

9. The method according to claim 8 and further moving a first screw device connecting the first and second slides together from a first fixed position securing the first and second slides in fixed relation to one another and a first open position permitting the first and second slides to slide with respect to one another; and moving a second screw device connecting the second and third slides together from a second fixed position securing the second and third slides in fixed relation to one another and a second open position permitting the second and third slides to slide with respect to one another.

10. The method of claim 9 and further comprising sliding the first slide and the second slide one way and sliding the third slide opposite to the one way.

11. The method of claim 8 wherein the step of extending the third abutment of the third slide beyond the first abutment of the first slide by the predetermined distance comprises placing a block having the actual thickness corresponding to the desired cut distance between the first stop of the first slide and the second stop of the second slide and embracing the first stop and the second stop around the block, whereby the abutment surface of the third slide projects beyond the abutment surface of the first slide the desired cut distance less the kerf width.

12. The method according to claim 8 and further comprising routing out the spaces between the first and second kerfs.

13. The method according to claim 8 and further comprising adding a third slide having an abutment face thereon, extending the first slide a kerf width beyond the abutment face of the third slide.

* * * * *